United States Patent [19]

Paitchell

[11] 3,949,213

[45] Apr. 6, 1976

[54] UNDERWATER LIGHT

[75] Inventor: Harold Paitchell, Clifton, N.J.

[73] Assignee: Hayward Manufacturing Company, Inc., Elizabeth, N.J.

[22] Filed: Feb. 11, 1974

[21] Appl. No.: 441,197

[52] U.S. Cl. ..... 240/26; 174/51; 240/47; 339/14 R

[51] Int. Cl.[2] ..... F21V 31/00

[58] Field of Search ..... 240/26, 47; 174/51; 339/14 R, 14 L

[56] References Cited

UNITED STATES PATENTS

| | | | |
|---|---|---|---|
| 1,088,101 | 2/1914 | Schmmel | 174/51 X |
| 1,308,423 | 7/1919 | Horton | 174/51 |
| 2,727,086 | 12/1955 | Madaras | 174/51 |
| 3,339,066 | 8/1967 | Hart | 240/26 |
| 3,456,103 | 7/1969 | Bond | 240/26 |

FOREIGN PATENTS OR APPLICATIONS

| | | | |
|---|---|---|---|
| 1,175,962 | 1/1970 | United Kingdom | 240/26 |

*Primary Examiner*—Fred L. Braun

[57] ABSTRACT

An underwater light is provided for use particularly with swimming pools, having fail-safe twin grounding connectors to prevent electrical grounding through the water in event of failure of one grounding connection.

10 Claims, 4 Drawing Figures

UNDERWATER LIGHT

The increasing popularity of swimming pools has created a demand for underwater lighting. In order to cope with the problems arising from underwater use of electric lights, special watertight designs have been necessary.

Kelly, Jr., U.S. Pat. No. 3,265,884, patented Aug. 9, 1966, acknowledges that underwater lights must be made watertight in order to avoid a shock hazard to swimmers coming into contact with the lights. Kelly provided a watertight strain relief connector 27 extending through the housing shell and carrying a three-conductor cable, two of the conductors being connected to the terminals of the lamp, and the third conductor being a ground conductor, electrically connected to the interior of the housing shell, so that all the exposed metal parts of the light are in conducting relation to the shell, and are thereby grounded through the cable 26, which is connected at the other end to ground outside the pool.

The difficulty with this type of connection, as pointed out by Nash, U.S. Pat. No. 3,337,725, patented Aug. 22, 1967, is that in the event of water leakage into the lighting fixture and into contact with the electrical connections, such as through cracking of the lens, the pool water can become electrically conducting, and present a dangerous shock hazard to swimmers. This hazard is increased in the event of failure of the ground connector. Nash's design accordingly provides for installation of the light under water in a manner such that all electrical wiring and connections leading to the light are above the maximum water level in the pool. In this way, the probability of the light circuit's ever being grounded through the water of the pool becomes practically an impossibility, even should the water gain free access to the light interior. Such a design imposes severe restrictions upon the positioning of the lights in the pool, however, and cannot always be adopted.

Hart, U.S. Pat. No. 3,339,066, patented Aug. 29, 1967, sought to avoid these difficulties by providing a waterproof connection between the contact posts of the lamp and the electrical conducting wires by using a mass of waterproof sealing material, and running the conduit for the wires from this mass of material all the way to beyond the level of the pool. Hart ran the grounding connection to the outside of the light housing, in contact with the water, which in the event of failure of the grounding connection can also lead to grounding of the circuit through the water of the pool.

In accordance with the instant invention, an underwater light is provided for bodies of water such as swimming pools, for use with electrical and grounding connections that are totally immersed in water, having fail-safe twin grounding connections, to prevent electrical grounding through the water in the event of failure of one grounding connection, comprising, in combination, a light receptacle disposed in a housing shell; an electric light within the light receptacle; nonelectrically conducting conduit means attached in a seal to the housing shell for entry of electrical and grounding line connections leading from an electric power source and a ground, respectively, outside the swimming pool; electrical line connections extending through the conduit means from the electric power source and leading to the electric light within the light receptacle; a first grounding connection attached to the inside of the light receptacle for grounding attachment of a first grounding line connection extending through the conduit means to a ground outside the body of water; and a second grounding connection extending through the conduit means and attached to the housing shell for grounding attachment of a second grounding line connection extending to a ground outside the body of water.

In a preferred embodiment, the second grounding connection is at an inner face of an electrically-conducting grounding member attached to the housing in a watertight seal and extending through the housing, with an external grounding connection at an outer face of the grounding member, for attachment of the second grounding line connection to other underwater lights in the body of water, so that all can be connected to the same second grounding line connection. In one form, the grounding member is a boss having a recess on each side of the inner and outer faces thereof, and a locking member in each recess containing a grounding line connection therein in electricallyconducting contact with the boss and the housing.

A preferred embodiment of the invention is illustrated in the drawings, in which.

Figure 1:
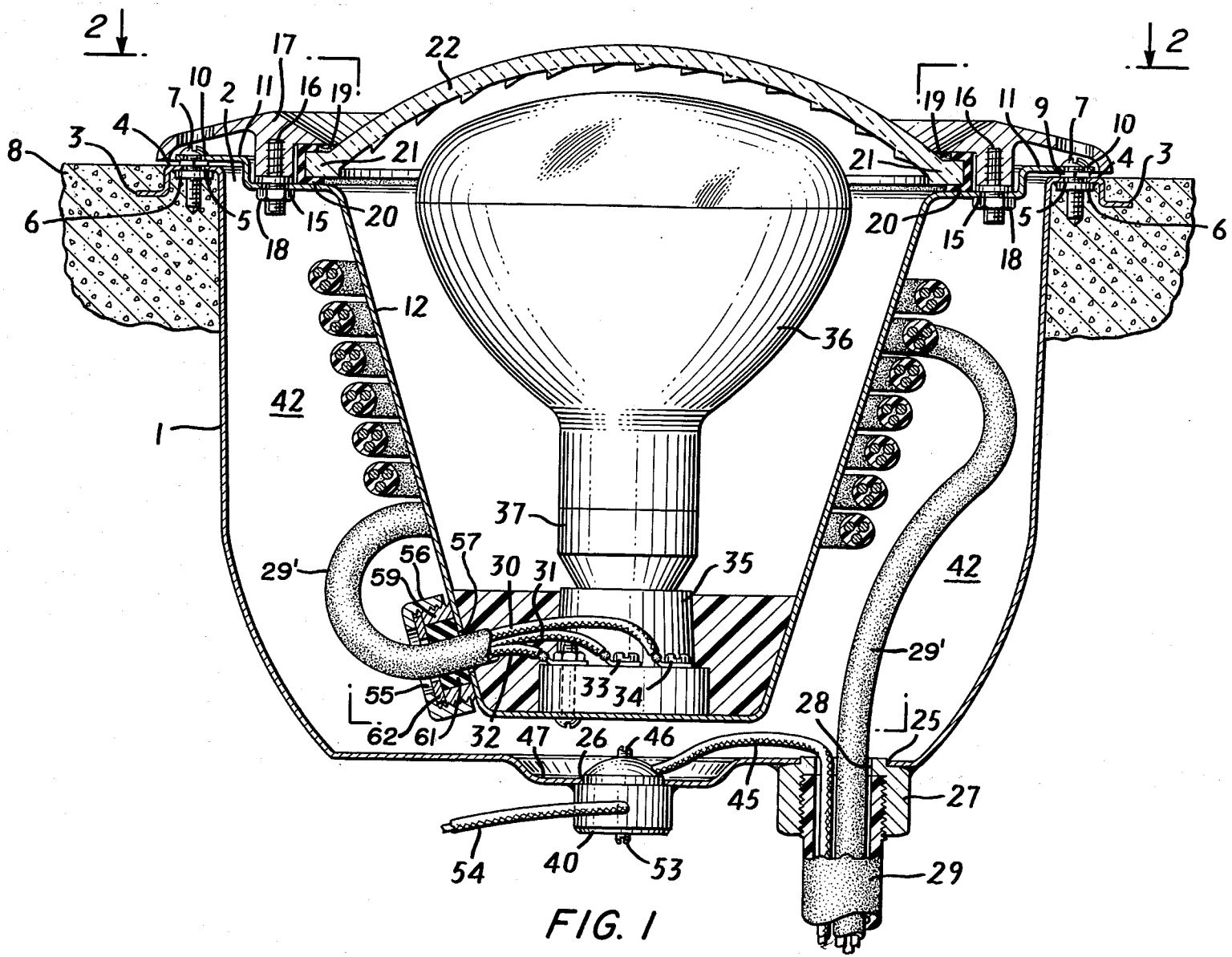
FIG. 1 represents a longitudinal section through an underwater light in accordance with the invention.
Figure 2:
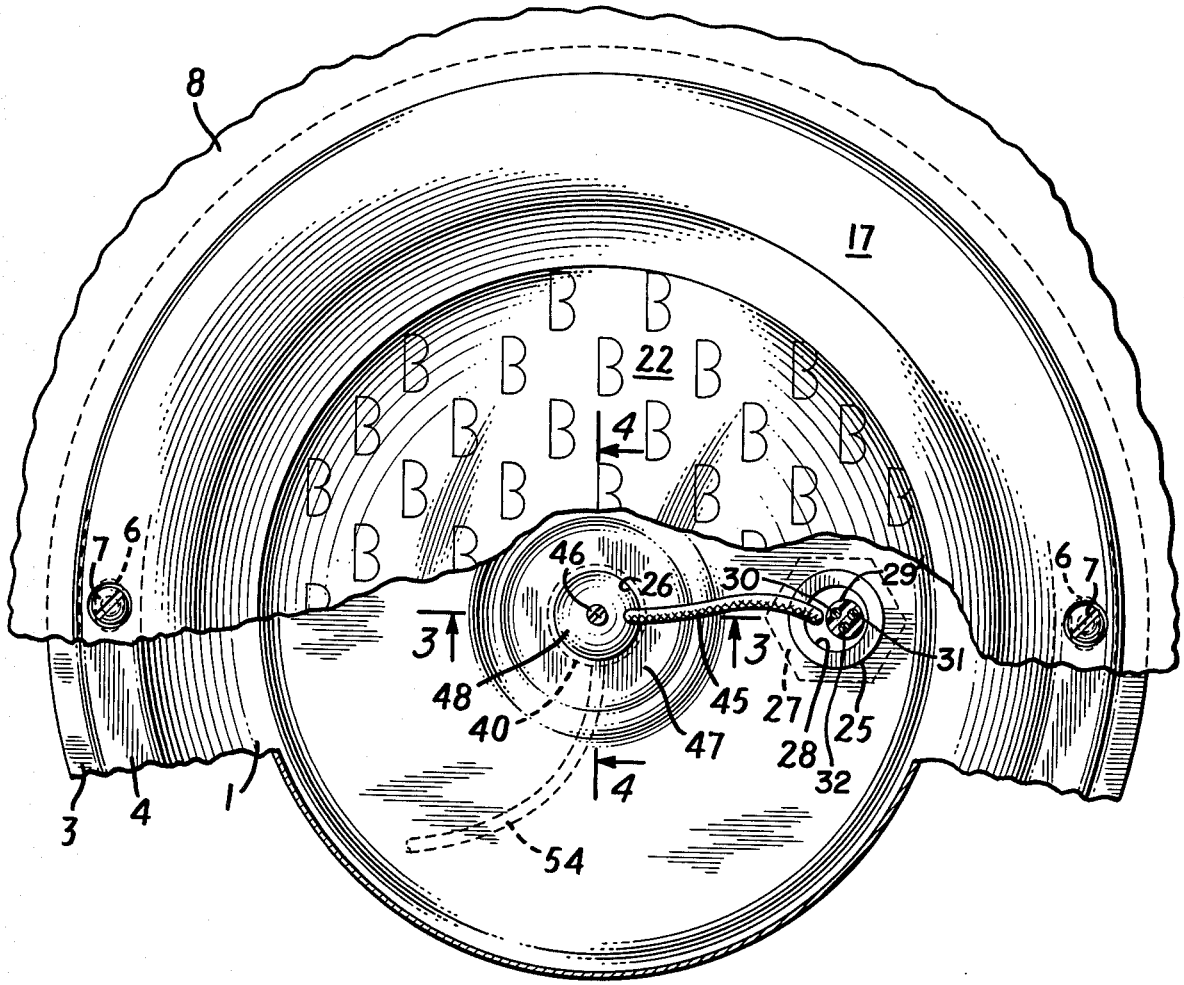
FIG. 2 represents a cross-sectional view taken along the line 2—2 of FIG. 1.
Figure 3:
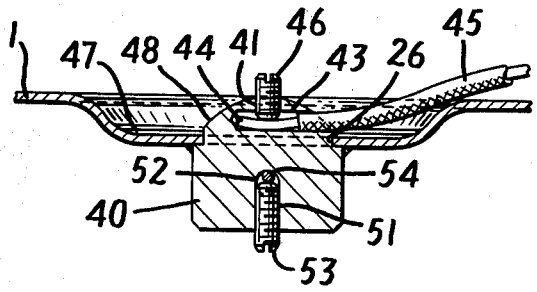
Figure 4:
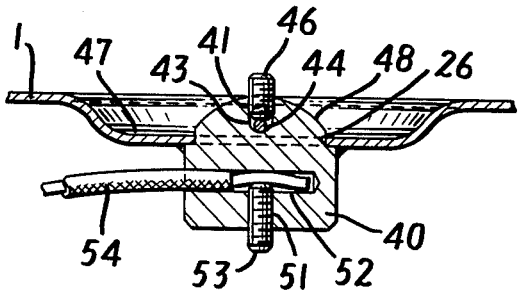

FIG. 3 is a detailed view of the grounding member shown in FIGS. 1 and 2, taken along the line 3—3 of FIG. 2; and FIG. 4 is another longitudinal section of the grounding member taken along the line 4—4 of FIG. 2.

The underwater light shown in FIGS. 1 to 4 has a hemispherical housing shell 1, open along one side 2, and provided with a peripheral flange 3 with a flat sealing face 4. At spaced intervals along flange 3 are apertures 5 and weld nuts 6 for reception of screws 7. The housing shell is imbedded in the pool wall 8, held there at flange 3. The screws extend through apertures 10 on the flange 11 of the light receptacle 12, and attach the receptacle to the shell. Nuts 9 threaded on screws 7 serve as spacers between the housing 1 and receptacle 12, to define a small clearance therebetween, so that pool water may enter the space 42 and cool the receptacle 12. The flange 11 has a number of apertures 15, through which extend the stub screws 16 of the face plate 17, and the nuts 18 threaded on the ends of the screws 16 retain the face plate 17 to the receptacle 12. The face plate 17 has a peripheral recess 19, which receives the V-gasket 20, embracing the edge 21 of a lamp lens 22. The gasket forms a watertight seal between the lens, receptacle and plate, thus preventing entry of water into the interior of the receptacle 12.

At its opposite end, the housing shell 1 is provided with two apertures 25 and 26. Attached through aperture 25 is a brass connector 27 having a central passage 28 therethrough. The connector is brazed in place to the housing shell in a watertight seal at the periphery of the aperture 25. A plastic nonelectrically-conducting conduit 29 is attached to the brass connector 27, and carries plastic three-wire cable 29', which includes two electrical line connections and the first grounding connection and extends into the receptacle 12. The cable 29' is attached to the receptacle, also in a watertight seal, and carries two electrical "hot" lines 30, 31 and one grounding connector line 32. The mode of attachment of the cable 29′ to the receptacle is best seen in FIG. 1. The cable 29′ extends through aperture 55 of lock nut 56 and aperture 57 of receptacle 12. The lock nut 56 is threadably mounted on the boss 59, and a seal is established between ring gasket 61, the cable 29′, and the outside receptacle 12 at aperture 57, under compression through washer 62 of the tightly screwed-down lock nut 56 on boss 59. The conduit 29 can also be of metallic electrically conducting material, if desired. The hot lines 30, 31 are attached to the terminals 33 and 34 of the lamp socket 35, which in turn is attached to the light receptacle 12. The grounding connector line 32 is attached to the socket 35. The lamp 36 is attached to the socket at its base 37, and thus grounded through the receptacle 12. Attached to the shell by brazing in a watertight seal and extending through aperture 26 is a brass grounding connector 40. A threaded blind socket 41 through the grounding connector 40 receives a set screw 46, and blind bore 43 receives the end 44 of a second grounding connector line 45, which is attached thereby by set screw 46. This ground also extends through conduit 29 via connector 27 to ground.

It will be noted that there is a recess 47 at the base of the housing shell, and the inner face 48 of the grounding connector 40 does not extend into the interior of the shell beyond the depth of the recess, thus not obstructing the interior open space of the shell in any way.

The outer portion of the grounding connector 40 is also provided with twin blind bores 51 and 52, one of which receives a set screw 53, and the other of which receives the end of a third grounding connector line 54, the set screw 53 retaining the grounding connector line 54 in the bore, in like manner as does the set screw 46 retaining the grounding connector line 45 on the inner face of the grounding connector. Thus, grounding connector lines 45 and 54 are attached to the same ground outside the body of water via conduit 29. The line 54 extends to other underwater lights, and connects them all, therefore, to the same ground via conduit 29. Each light also has its direct first ground line connection 32 via conduit 29.

It will also be noted that none of the blind bores 51, 52 in the grounding connector on the outside face is in fluid flow connection with any of the bores 41, 43 on the inside face. Only the bores on the inner face and the outer face, respectively, intersect. Thus, there is no fluid flow connection from the inside to the outside of the housing shell by way of the grounding connector, and the watertightness of the interior of the shell is thereby preserved.

In this way, the major electrical connections with the lamp are made watertight, and all the metal parts of the housing and the lamp are in electrically grounding connection through double or twin grounding lines. Failure of one grounding line connection to function does not lead to grounding of the circuit through the body of water, because of the existence of another grounding line connection, attached in different locations in the receptacle for maximum avoidance of damage to both grounding line connections at the same time.

While the housing as shown is hemispherical or bowl-shaped, it will of course be understood that the housing can have any configuration adapted for use with a lamp of standard type. Any type of electric lamp can be used, such as sealed-beam headlight lamps, which are readily available and inexpensive, as well as screw-type or bayonet-type incandescent lamps, mercury vapor lamps, and sodium vapor lamps, as well as fluorescent lamp tubes.

The housing shell, light receptacle, and grounding connector parts can be made of any electrically-conducting metallic or other material, but for obvious reasons the material is preferably corrosion-resistant. Stainless steel, brass, bronze, zinc-plated steel, and corrosion-resistant alloys of various types can be used. These can if desired be imbedded in non-electrically-conducting water-resistant potting compounds or protective coatings after electrical connections are made, to help shield the connections from corrosion.

Having regard to the foregoing disclosure, the following is claimed as the inventive and patentable embodiments thereof:

1. An underwater light for a body of water for use with electrical and grounding connections that are totally immersed in water and having fail-safe twin grounding connections to prevent electric grounding through the water in event of failure of one grounding connection, comprising, in combination, a housing; a water-tight receptacle in the housing; an electric light within the receptacle; water-tight non-electrically-conducting conduit means attached in a water-tight seal to the housing for entry of electrical and grounding line connections leading from an electric power source and ground outside the body of water to the electric light within the receptacle; a first grounding connection attached to the inside of the receptacle for grounding attachment thereto of a first grounding line extending to a ground outside the body of water and entering the housing via the conduit means; and a second grounding connection attached to the housing for grounding attachment of a second grounding line extending to a ground outside the body of water.

2. An underwater light in accordance with claim 1, in which the housing has at least one opening therethrough admitting water therewithin, and the receptacle is spaced from the housing in a manner to allow water entering the housing to bathe the receptacle and cool it.

3. An underwater light in accordance with claim 1, in combination with a swimming pool comprising water-retaining side walls and a bottom wall, the underwater light being installed in one of the walls thereof.

4. An underwater light for a body of water for use with electrical and grounding connections that are totally immersed in water and having fail-safe twin grounding connections to prevent electric grounding through the water in event of failure of one grounding connection, comprising, in combination, a housing; an electric light within the housing in a receptacle; non-electrically-conducting conduit means attached in a water-tight seal to the housing for entry of electrical and grounding line connections leading from an electric power source and ground outside the body of water; electrical line connections extending through the conduit means from the electric power source to the electric light within the receptacle; a first grounding connection attached to the inside of the receptacle for grounding attachment thereto of a first grounding line extending through the conduit means to a ground outside the body of water and entering the housing via the conduit means; and a second grounding connection attached to the housing for grounding attachment of a second grounding line extending to a ground outside the body of water; and an electrically-conducting grounding member attached to the housing and extending through the housing, and having an inner face on the inside of the housing; and wherein the second grounding connection is attached to the inner face of the grounding member.

5. An underwater light in accordance with claim 4, having a third grounding connection attached to the electrically-conducting grounding member outside the housing.

6. An underwater light in accordance with claim 5, in which the grounding member is a boss and further includes an outer face outside the housing, a recess on each of the inner and outer faces thereof, and a locking member in each recess retaining a grounding line connection therein in electrically-conducting contact with the boss and the housing.

7. An underwater light in accordance with claim 6, in which each recess is a bore.

8. An underwater light in accordance with claim 4, in which the housing is a hemispherical shell.

9. An underwater light for a body of water for use with electrical and grounding connections that are totally immersed in water and having fail-safe twin grounding connections to prevent electric grounding through the water in event of failure of one grounding connection, comprising, in combination, a housing; an electric light within the housing in a water-tight receptacle; water-tight non-electrically-conducting conduit means attached in a water-tight seal to the housing for entry of electrical and grounding line connections leading from an electric power source and ground outside the body of water to the electric light within the housing, the housing having two apertures, with the conduit means attached to the housing at and extending through one aperture, and a grounding member attached to the housing at and extending through the other aperture; a first grounding connection attached to the inside of the housing for grounding attachment thereto of a first grounding line extending to a ground outside the body of water and entering the housing via the conduit means, and a second grounding connection attached to the grounding member for grounding attachment of a second grounding line extending to a ground outside the body of water.

10. An underwater light in accordance with claim 9, in which the conduit member and the grounding member are each brazed to the housing.

* * * * *

Disclaimer 3,949,213.—*Harold Paitchell*, Clifton, N.J. UNDERWATER LIGHT. Patent dated Apr. 6, 1976. Disclaimer filed Aug. 15, 1977, by the assignee, *Hayward Manufacturing Co., Inc.*

Hereby enters this disclaimer to claims 1 to 3, inclusive, and claims 8 to 10, inclusive, of said patent.

[*Official Gazette October 11, 1977.*]